US007014511B2

(12) United States Patent
Sagawa et al.

(10) Patent No.: US 7,014,511 B2
(45) Date of Patent: Mar. 21, 2006

(54) ELECTRICAL CONNECTOR

(75) Inventors: Tetsuya Sagawa, Kodaira (JP); Yasumasa Aita, Machida (JP); Tomoaki Kajii, Sagamihara (JP); Ryo Sawada, Isehara (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 10/953,634

(22) Filed: Sep. 29, 2004

(65) Prior Publication Data

US 2005/0085126 A1 Apr. 21, 2005

(30) Foreign Application Priority Data

Oct. 16, 2003 (JP) ..... 2003-356654

(51) Int. Cl.
*H01R 13/514* (2006.01)

(52) U.S. Cl. ..... 439/752; 439/912

(58) Field of Classification Search ..... 439/304, 439/352, 725, 752, 912
See application file for complete search history.

(56) References Cited

U.S. PATENT DOCUMENTS 5,454,740 A * 10/1995 Sakano et al. ..... 439/752
5,718,603 A * 2/1998 Watanabe et al. ..... 439/489
6,149,462 A * 11/2000 Sugie ..... 439/595
6,589,079 B1 * 7/2003 Kashiyama et al. ..... 439/595
6,699,079 B1 * 3/2004 Machida et al. ..... 439/752
6,814,627 B1 * 11/2004 Yamamoto et al. ..... 439/701
2005/0085126 A1 * 4/2005 Sagawa et al. ..... 439/595

FOREIGN PATENT DOCUMENTS

| | | |
|---|---|---|
| EP | 0 918 372 A2 | 5/1999 |
| EP | 0 984 521 A1 | 3/2000 |
| JP | 2000-182743 | 6/2000 |
| JP | 2001-110526 | 4/2001 |

* cited by examiner

*Primary Examiner*—Tho D. Ta
*Assistant Examiner*—James R. Harvey
(74) *Attorney, Agent, or Firm*—Barley Snyder LLC

(57) ABSTRACT

An electrical connector comprises an insulating housing having a plurality of contact accommodating cavities extending from a front side to a rear side of the housing. Each of the contact accomodating cavities has a first probe receiving opening formed adjacent thereto. A retainer that is moveable between a temporary locking position and a main locking position is attached to the front side of the housing. The contact accomodating cavities are accesible through the first probe receiving openings when the retainer is in the temporary locking position, and the contact accomodating cavities are accesible through second probe receiving openings formed in the retainer when the retainer is in the main locking position.

17 Claims, 9 Drawing Sheets

ELECTRICAL CONNECTOR

FIELD OF THE INVENTION

The invention relates to an electrical connector having a housing with contacts connected to electrical wires of a wire harness, for example, an automobile wire harness.

BACKGROUND OF THE INVENTION

A wire harness is constructed from numerous electrical wires, contacts, and the like. The contacts may be, for example, connected to the electrical wires of the wire harnesses and then arranged in a housing of an electrical connector. A locking arm may be disposed in the housing to secure the contacts and to prevent the contacts from slipping out of the housing.

In order to prevent erroneous wiring of the wire harness and in order to prevent faulty connections between the contacts and the electrical wires, an electrical continuity check of the electrical connector is required. One example of an electrical continuity testing method is shown in FIGS. 11A, 11B, and 11C and is further illustrated in Japanese Patent Application Kokai No. 2000-182743. FIGS. 11A, 11B and 11C, show an electrical connector 101 having an insulating housing 110. A plurality of contact accommodating passageways 111 are formed in two rows (upper and lower) in the housing 110. A plurality of contacts 120 is accommodated in the contact accommodating passageways 111. A rear holder 130 has locking arms 131 for securing the contacts 120.

Each of the contacts 120 includes a securing member 121 that is secured to the rear holder 130, a male contact member 122 that extends forward (toward the left in FIG. 11A) from the securing member 121, and an electrical wire connecting member 123 that extends rearward from the securing member 121. The electrical wire connecting member 123 is connected to an electrical wire 140 of a wire harness (not shown) by crimping. The rear holder 130 is inserted from a rear side of the housing 110 and is locked to the housing 110 in either a temporary locking position shown in FIG. 11A or a main locking position shown in FIG. 11C. The temporary locking position allows insertion of the contacts 120 into the housing 110, and the main locking position fully secures the contacts 120 in the housing 110.

A first opening 114 is formed in a top wall 112 of the housing 110 and communicates with the contact accommodating passageways 111 of the upper row. A second opening 115 is formed in a bottom wall 113 of the housing 110 and communicates with the contact accommodating passageways 111 of the lower row. The first and second openings 114, 115 are formed in positions that allow contacts 153, 154 of electrical continuity check probe tools 151, 152 to contact the securing members 121 of the contacts 120 when the rear holder 130 is in the temporary locking position.

Thus, in cases where an electrical continuity check is performed on the electrical connector 101, as shown in FIG. 11A, the contacts 120 are arranged in the contact accommodating passageways 111 of the housing 110 and the rear holder 130 is arranged in the temporary locking position. The electrical continuity check probe tools 151, 152 are then disposed above and below the housing 110. As shown in FIG. 11B, the electrical continuity check probe tools 151, 152 are closed so that the electrical continuity check probe tools 151, 152 are attached to the housing 110. The contacts 153, 154 of the electric continuity check probe tools 151, 152 pass through the first and second openings 114, 115 of the housing 110 so that the contacts 153, 154 of the electric continuity check probe tools 151, 152 contact the securing members 121 of the contacts 120. Accordingly, the harness circuit is checked via the necessary detection circuit that is connected to the electrical continuity check probe tools 151, 152. After the electrical continuity check has been completed, the rear holder 130 is pushed with a specified force by a push-in jig 160 to the main locking position, as shown in FIG. 11C.

In the electrical continuity testing method shown in FIGS. 11A, 11B, and 11C, the contacts 153, 154 of the electrical continuity check probe tools 151, 152 are caused to contact the contacts 120 via the first and second openings 114, 115 formed in the top wall 112 and bottom wall 113 of the housing 110, respectively. Accordingly, there is no need to insert the electrical continuity check probe tools 151, 152 into an opening at a front of the housing 110.

Another example of an electrical continuity testing method is shown in FIG. 12 and is further illustrated in Japanese Patent Application Kokai No. 2001-110526. As shown in FIG. 12, electrical connector 201 has an insulating housing 210. A plurality of contact accommodating cavities 211 is formed in a single row inside the housing 210. A plurality of contacts 220 is arranged in the contact accommodating cavities 211. A locking arm 212 for securing the contacts 220 is disposed inside each of the contact accommodating cavities 211. An opening 213 that allows flexing of the corresponding locking arm 212 is formed beneath each of the locking arms 212 (below in FIG. 12). An insertion groove 214 is formed in a top wall of the housing 210 at a front end (left end in FIG. 12) of each of the contact accommodating cavities 211.

Each of the contacts 220 includes a substantially box-like receptacle 221 that is secured by the locking arm 212, and an electrical wire connecting member 222 that is connected by crimping to an electrical wire 240 of a wire harness (not shown). An elastic contact member 223 that makes elastic contact with a mating contact (not shown) is disposed inside the receptacle 221. A retainer 230 is inserted from a front side of the housing 210. The retainer 230 includes a retaining arm 231. The retaining arm 231 advances into the opening 213 formed beneath the locking arm 212 and prevents downward movement of the locking arm 212. A cut-out 232 communicates with the insertion groove 214 and is formed in a front edge of an upper surface of the retainer 230. An innermost surface of the cut-out 232 is formed as an inclined surface 233 with a downward slope.

During assembly of the electrical connector 201, the contacts 220 are inserted into the contact accommodating cavities 211 from the rear of the housing 210. As the contacts 220 are inserted, the contacts 220 cause the locking arms 212 to bend downward. When the contacts 220 are pushed in to a specified position, the locking arms 212 return to their original position and tentatively secure the contacts 220 in the housing 210. In this state, the upper surfaces of the front ends of the receptacles 221 of the contacts 220 are directly positioned beneath the insertion grooves 214. When insertion of all of the contacts 220 has been completed, the retainer 230 is fit over the front of the housing 210 and is pushed into the housing 210 until the retainer 230 is fully locked to the housing 210 in a main locking position. In the main locking position, the retaining arm 231 enters the opening 213 formed beneath the locking arms 212 and locks the contacts 220 in position.

Thus, in cases where an electrical continuity check is performed on the electrical connector 201 after assembly has been completed, an electrical continuity probe 250 is inserted from the front of the housing 210 at an inclination and with a tip end of the electrical continuity probe 250 oriented downward, as shown in FIG. 12. The electrical continuity probe 250 passes through the cut-out 232 of the retainer 230 and is inserted into the insertion groove 214 at an inclination until it is caused to contact the upper surface of the receptacle 221 of each of the contacts 220. As a result, an electrical continuity check is performed. Because the electrical continuity probe 250 is caused to contact the upper surface of the receptacle 221, which has a relatively high rigidity, deformation of the contacts 220 and, especially, deformation of the contact members 223, can be greatly suppressed during the electrical continuity check.

In the electrical continuity check method shown in FIGS. 11A, 11B and 11C, although an electrical continuity check can be performed when the rear holder 130 is in the temporary locking position, an electrical continuity check cannot be performed when the rear holder 130 is in the main locking position. Meanwhile, in the electrical continuity check method shown in FIG. 12, although an electrical continuity check can be performed when the retainer 230 is in the main locking position, no disclosure is made indicating that an electrical continuity check can be performed before the retainer 230 is fully locked to the housing 210. Because electrical continuity checks are typically performed by a harness maker, an automobile maker using the electrical connector, or the like, the tester is limited to performing the electrical continuity check when either the retainer is in a temporary locking position or a main locking position.

SUMMARY OF THE INVENTION

It is therefore an object of the present invention to provide an electrical connector wherein it is possible to perform an electrical continuity check when the retainer is in a temporary locking position and when the retainer is in a main locking position.

This and other objects are achieved by an electrical connector comprising an insulating housing having a plurality of contact accommodating cavities extending from a front side to a rear side of the housing. Each of the contact accomodating cavities has a first probe receiving opening formed adjacent thereto. A retainer that is moveable between a temporary locking position and a main locking position is attached to the front side of the housing. The contact accomodating cavities are accesible through the first probe receiving openings when the retainer is in the temporary locking position, and the contact accomodating cavities are accesible through second probe receiving openings formed in the retainer when the retainer is in the main locking position.

BRIEF DESCRIPTION OF THE DRAWINGS

FIG. 1A is a plan view of the electrical connector; and FIG. 1B is a sectional view taken along line 1B—1B of FIG. 1A.

FIG. 2A is a plan view of the electrical connector; and FIG. 2B is a sectional view taken along line 2B—2B of FIG. 2A.

DETAILED DESCRIPTION OF THE INVENTION

Figure 1A:
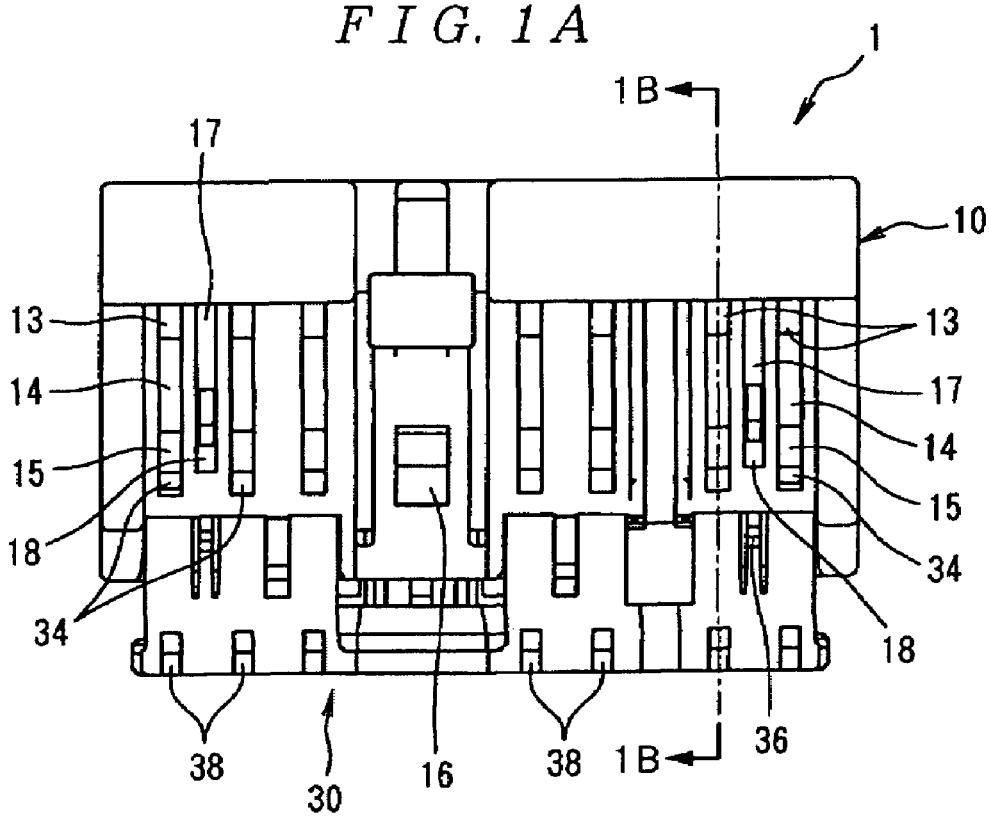
FIGS. 1A and 1B show an electrical connector of the present invention in a state in which a retainer is in a temporary locking position.
Figure 1B:
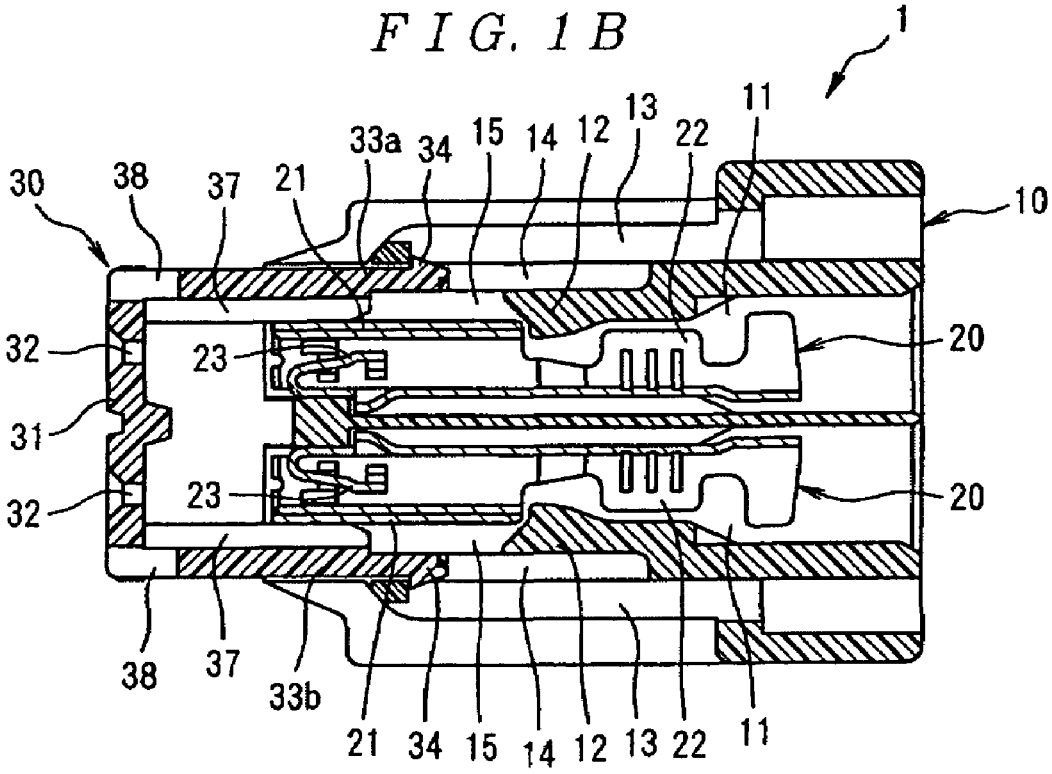
Figure 2A:
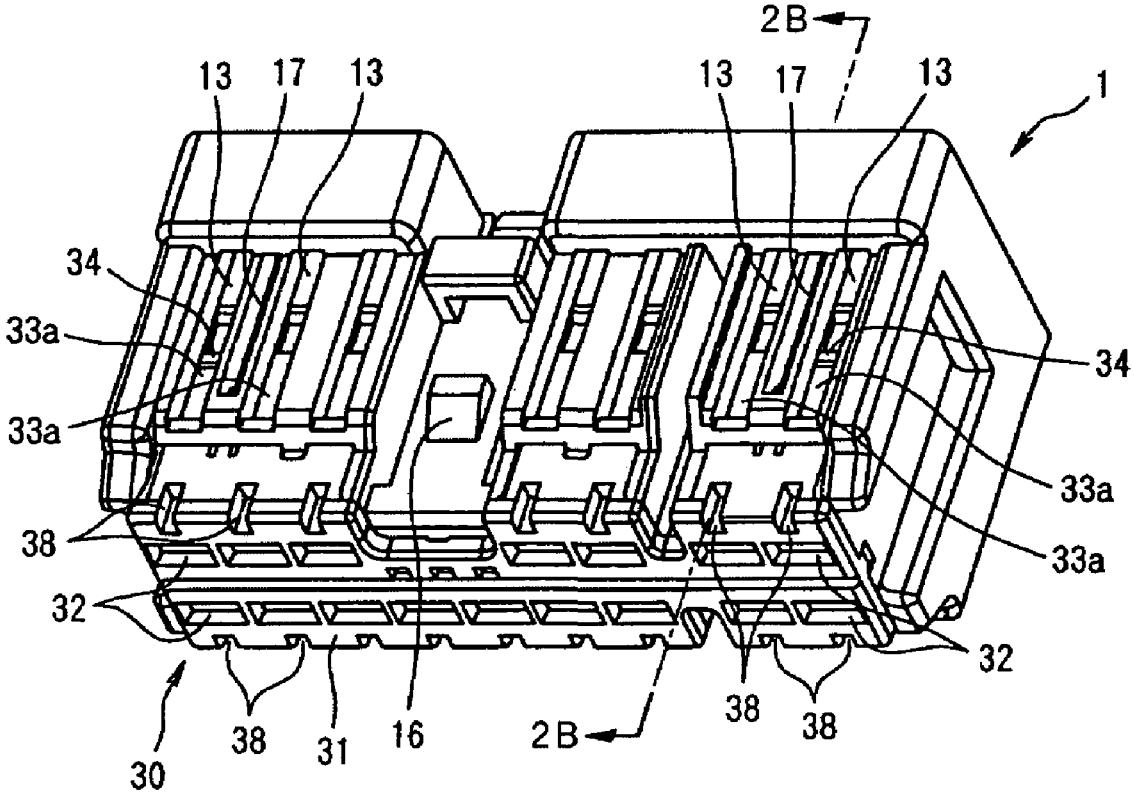
FIGS. 2A and 2B show the electrical connector of the present invention in a state in which the retainer is in a main locking position.
Figure 5:
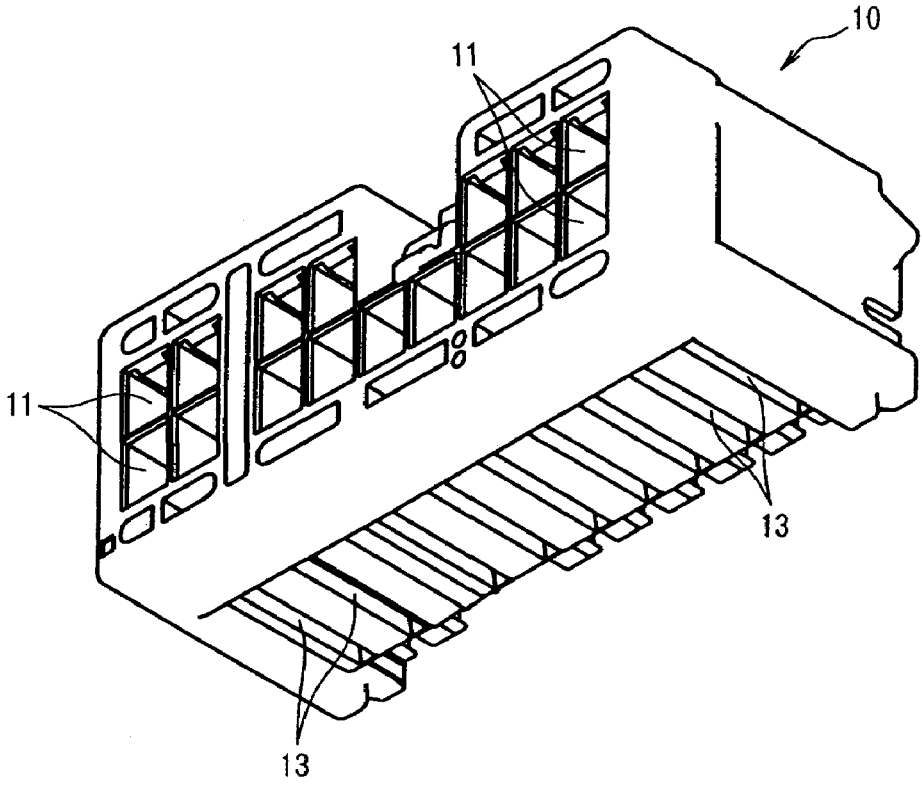
FIG. 5 is a perspective view of the housing viewed from the rear at an inclination from below.

FIGS. 1A, 1B, 2A and 2B, show an electrical connector 1. As shown in FIGS. 1A–1B, the electrical connector 1 includes an insulating housing 10. The housing 10 has a substantially rectangular shape and is formed by molding a synthetic resin. A plurality of contact accommodating cavities 11 is formed in two rows (upper and lower rows) in a left-right direction (in the left-right direction in FIG. 1B) of the housing 10. As shown in FIGS. 3 and 5, each of the contact accommodating cavities 11 extends from a front side to a rear side of the housing. As shown in FIG. 1B, disposed in each of the contact accommodating cavities 11 is a locking arm 12. The locking arms 12 disposed in the upper rows of the contact accommodating cavities 11 extend forward at an inclination from a top wall of the housing 10. The locking arms 12 disposed in the lower rows of the contact accommodating cavities 11 extend forward at an inclination from a bottom wall of the housing 10.

Figure 3:
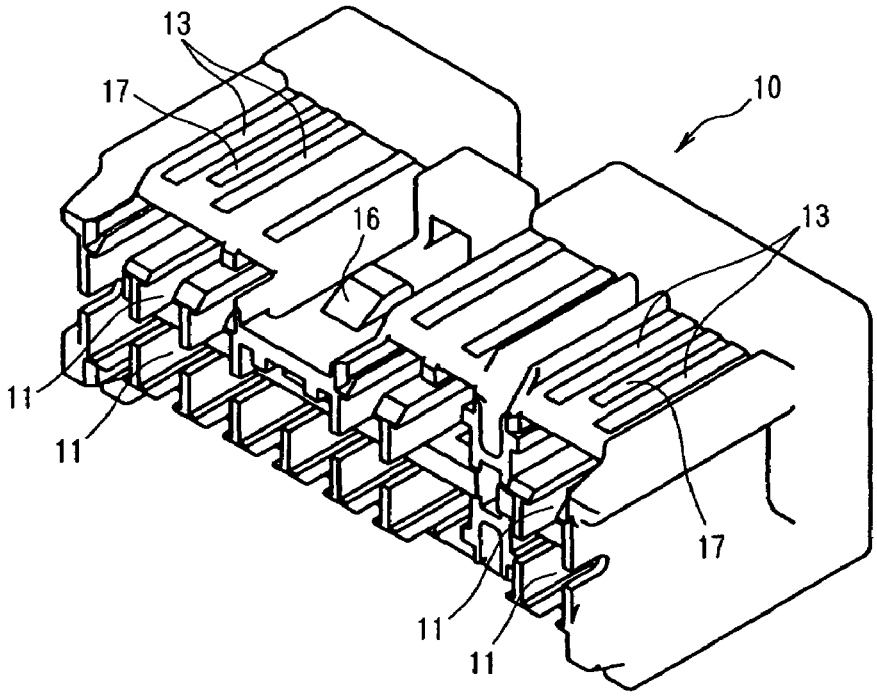
FIG. 3 is a perspective view of a housing viewed from a front at an inclination from above.
Figure 4:
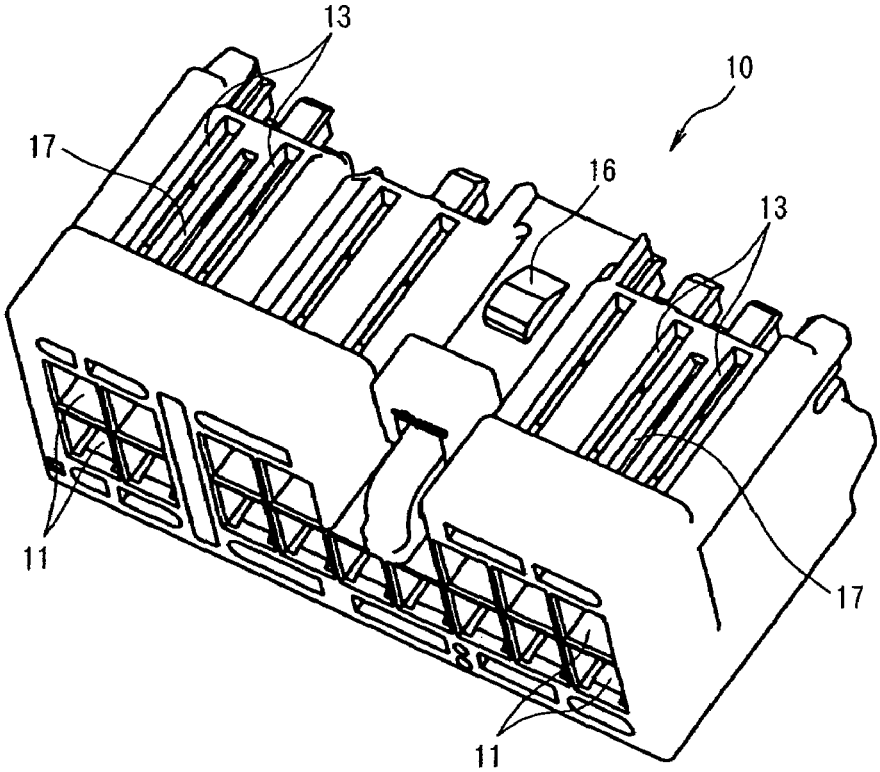
FIG. 4 is a perspective view of the housing viewed from a rear at an inclination from above.

As shown in FIGS. 1B, 3, and 5, a plurality of narrow first probe receiving openings 13 that extend in a forward-rearward direction are formed in the top wall and the bottom wall of the housing 10 in positions corresponding to the contact accommodating cavities 11. The first probe receiving openings 13 have a width narrower than the width of the respective contact accommodating cavities 11. Arm receiving openings 14 communicate with the first probe receiving openings 13 and are formed above the locking arms 12 of the upper row and beneath the locking arms 12 of the lower row. The retaining arm receiving openings 14 open on the front side of the housing 10. Abutment member receiving openings 15 communicate with the retaining arm receiving openings 14. The abutment member receiving openings 15 open on the front side of the housing 10 and are formed on a front side of the locking arms 12. As shown in FIG. 3, narrow projection receiving openings 17 that extend in the forward-rearward direction are formed in the top wall of the housing 10 between the first probe receiving openings 13 at the leftmost end of the housing 10 and between the first probe receiving openings 13 at the rightmost end of the housing 10. As shown in FIG. 1A, locking member receiving openings 18 are formed beneath the projection receiving openings 17 so that the locking member receiving openings 18 communicate with the projection receiving openings 17 and the retaining arm receiving openings 14. As shown in FIG. 4, a locking projection 16 that locks with a mating connector (not shown) is formed on the top wall of the housing 10.

Figure 2B:
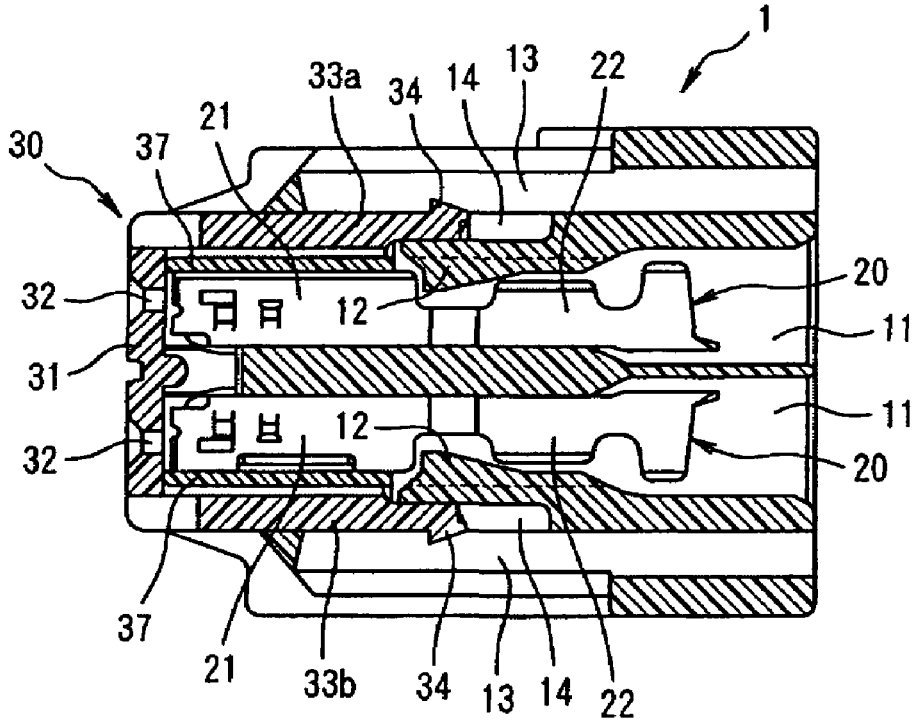
Figure 10A:
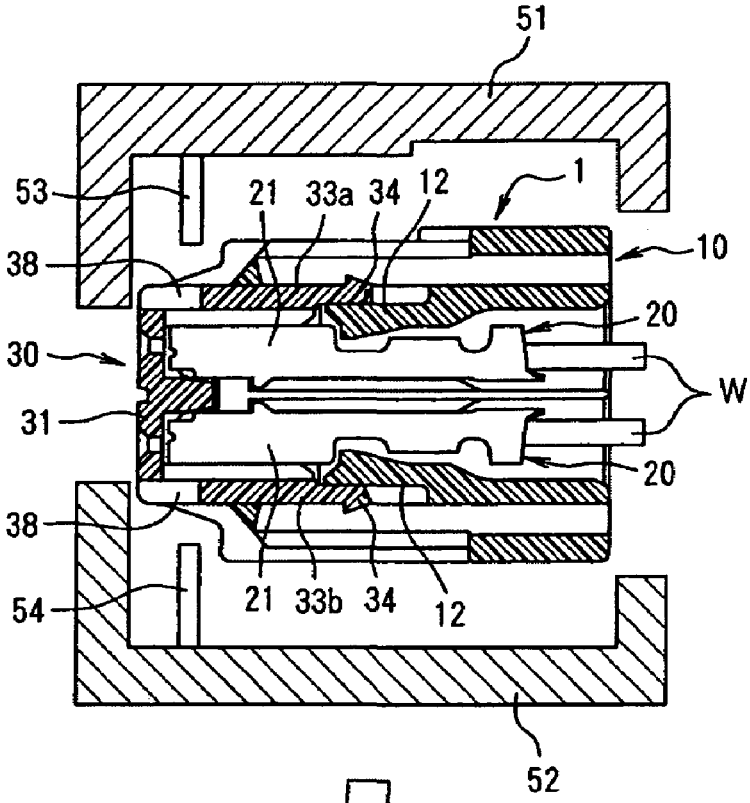
FIGS. 10A and 10B are sectional views of the electrical connector showing the electrical continuity check being performed when the retainer is in the main locking position.
Figure 10B:
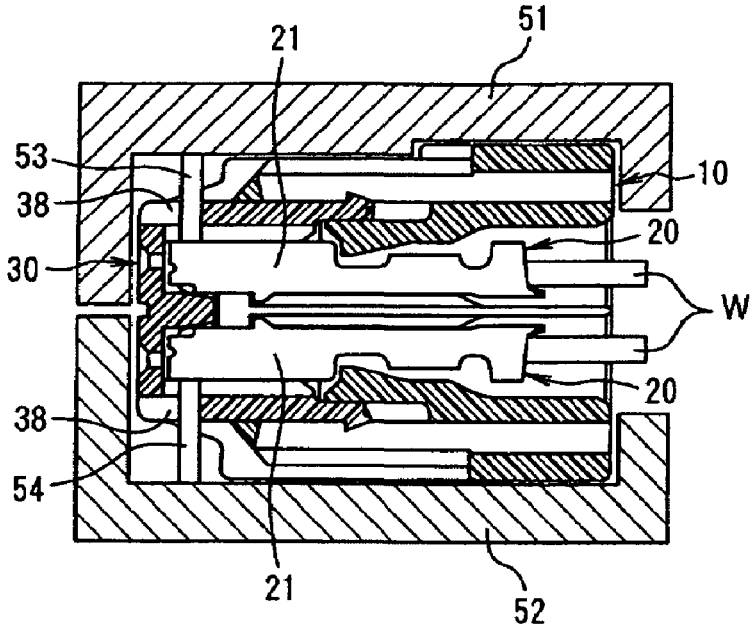
Figure 11A:
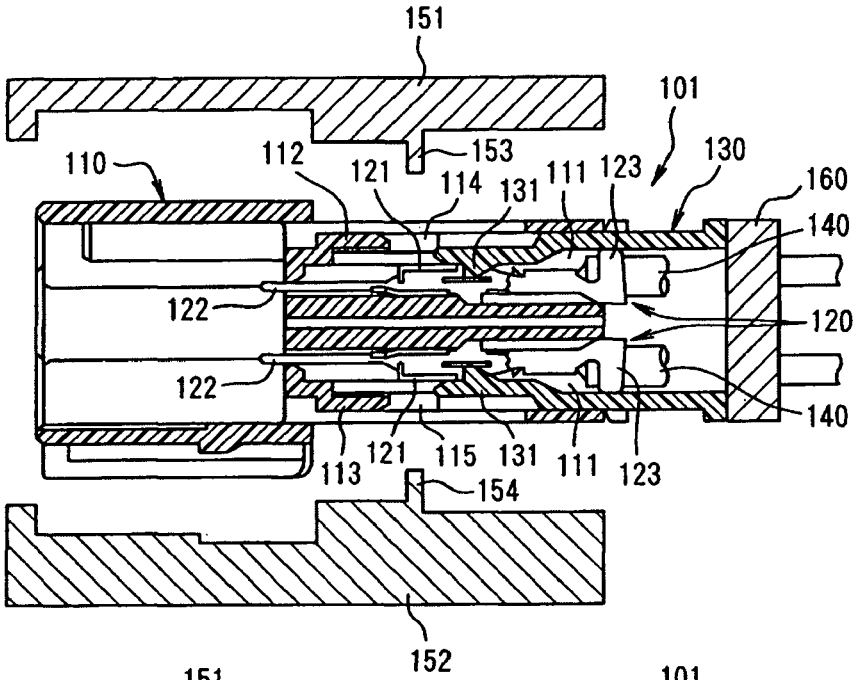
FIG. 11A PRIOR ART
FIGS. 11A, 11B and 11C are sectional views of a conventional electrical connector showing a conventional method for performing an electrical continuity check.
Figure 11B:
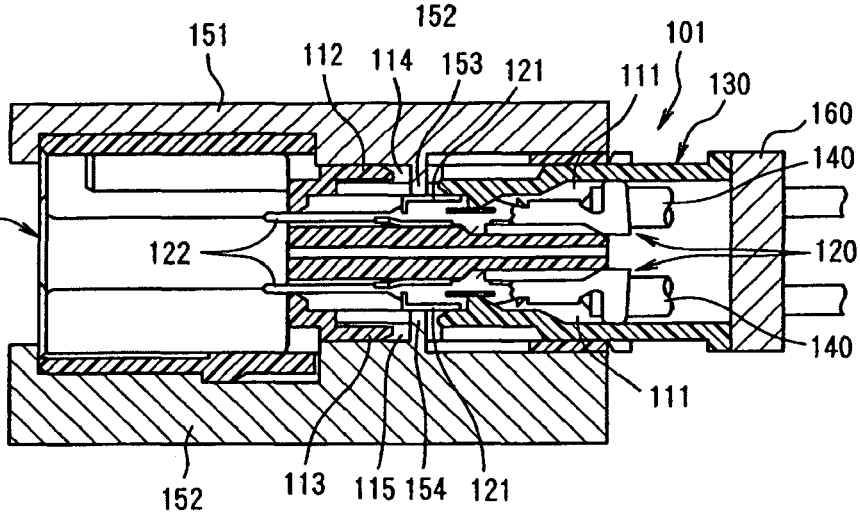
FIG. 11B PRIOR ART
Figure 11C:
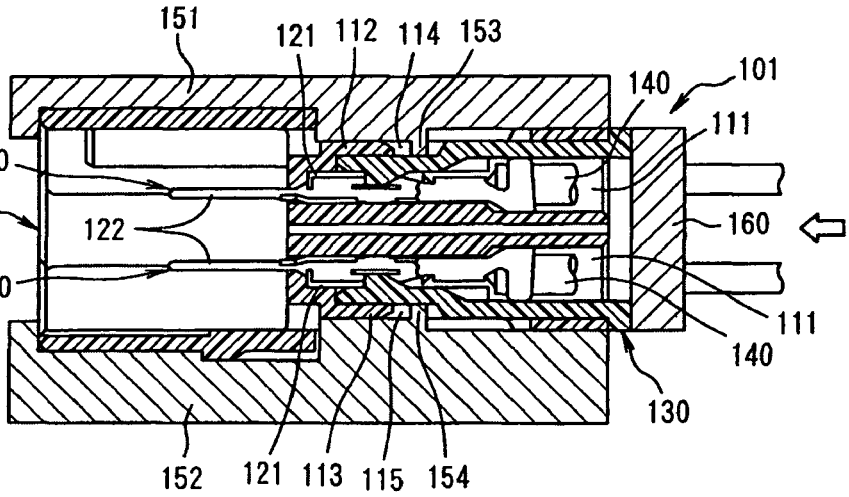
FIG. 11C PRIOR ART
Figure 12:
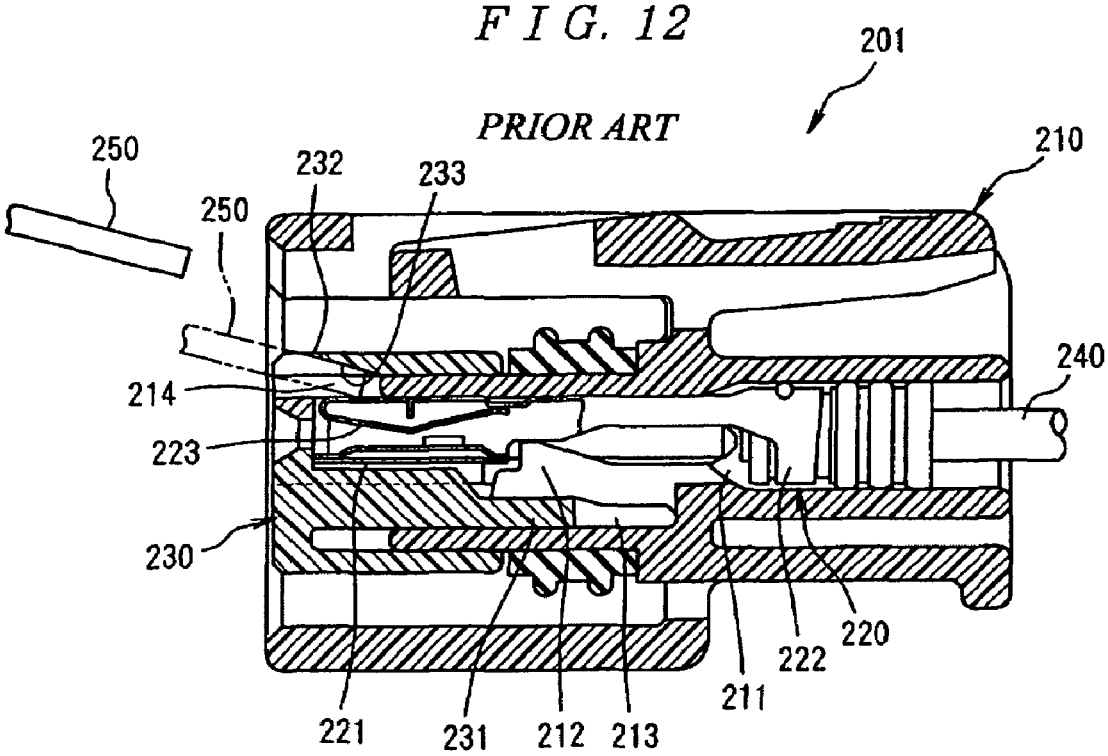
FIG. 12 PRIOR ART
FIG. 12 is a sectional view of another conventional electrical connector showing another conventional method for performing an electrical continuity check.

As shown in FIGS. 1B and 2B, a plurality of contacts 20 is accommodated in the rows of the housing 10. Each of the contacts 20 is formed by stamping and forming a metal plate and comprises a substantially box-like receptacle 21. The receptacle 21 is secured by the corresponding locking arm 12. An electrical wire connecting member 22 extends rearward from the receptacle 21 and is connected by crimping to an electrical wire W of a wire harness (not shown), as shown in FIGS. 10A and 10B. As shown in FIG. 1B, an elastic contact member 23 is disposed inside the receptacle 21 for contacting a mating contact (not shown).

Figure 6:
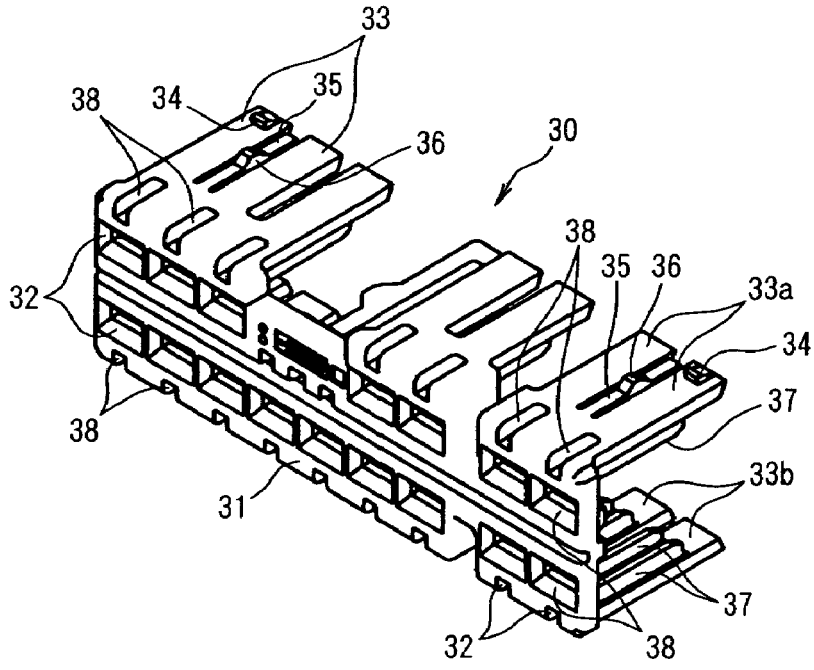
FIG. 6 is a perspective view of the retainer viewed from a front at an inclination from above.
Figure 7:
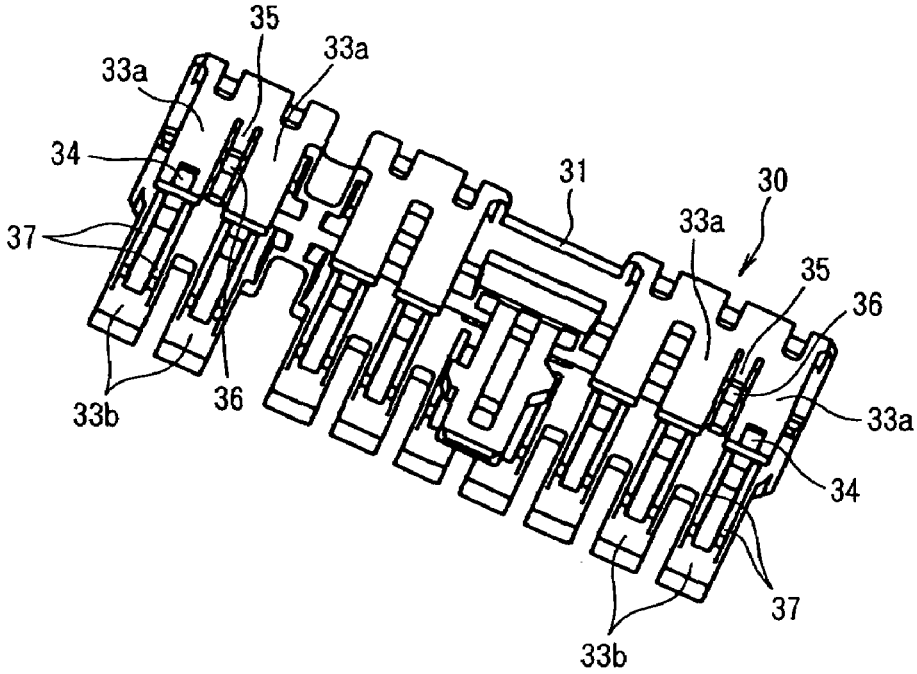
FIG. 7 is a perspective view of the retainer viewed from a rear at an inclination from above.
Figure 8:
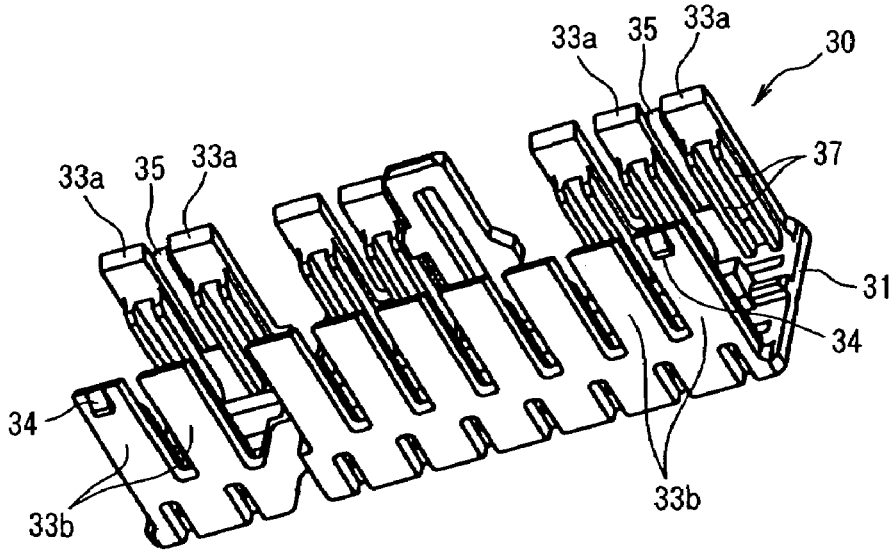
FIG. 8 is a perspective view in which the retainer viewed from the rear at an inclination from below.

A retainer 30 is inserted from the front surface of the housing 10 and is locked in the housing 10 in either a temporary locking position shown in FIGS. 1A and 1B, which allows insertion of the contacts 20 into the housing 10, or a main locking position shown in FIGS. 2A and 2B, which secures the contacts 20 in the housing 10. As shown in FIGS. 6, 7, and 8, the retainer 30 includes a flat rectangular plate 31 that extends in the direction of length (left-right direction in FIG. 1A) to cover the front surface of the housing 10. Pairs of upper arms 33*a* and lower arms 33*b* extend rearward from the respective upper and lower ends of the plate 31. The upper arms 33*a* are configured to enter into the retaining arm receiving openings 14 formed above the locking arms 12 in the main locking position and thereby restrict upward movement of the locking arms 12 to prevent the contacts 20 of the upper row from slipping out of the housing 10. The lower arms 33*b* enter into the retaining arm receiving openings 14 formed beneath the locking arms 12 in the main locking position and thereby restrict downward movement of the locking arms 12 to prevent the contacts 20 of the lower row from slipping out of the housing 10. Temporary locking projections 34 that prevent the retainer 30 from moving in the forward direction when the retainer 30 is in the temporary locking position are formed on rear ends of the upper arms 33*a* and lower arms 33*b* on both ends in the direction of length.

A plurality of mating contact passageways 32 are formed in two rows (upper and lower rows) in the plate 31 in positions corresponding to the contact accommodating cavities 11. Locking members 35 that enter into the locking member receiving openings 18 formed beneath the projection receiving openings 17 in the main locking position are formed between the upper arms 33*a* at the leftmost end and the upper arms 33*a* at the rightmost end of the retainer 30. Main locking projections 36 that are used to prevent the retainer 30 from being pushed in toward the rear when the retainer 30 is in the temporary locking position and used to prevent the retainer 30 from slipping out in the forward direction when the retainer 30 is in the main locking position are formed on the locking members 35.

A pair of abutment members 37 protrudes from the upper and lower arms 33*a*, 33*b*. The abutment members 37 are formed to enter the abutment member receiving openings 15 of the upper and lower rows to restrict the movement of the receptacles 21 of the contacts 20. Second probe receiving openings 38 are formed in front edges of the upper and lower arms 33*a*, 33*b*. The second probe receiving openings 38 are configured for receiving electrical continuity probes 53, 54 of electrical continuity check probe tools 51, 52 that access the contacts 20 when the retainer 30 is in the main locking position.

The method used to assemble the electrical connector 1 will now be described in greater detail. As shown in FIGS. 1A and 1B, the retainer 30 is first inserted onto the front surface of the housing 10 and is positioned in the temporary locking position. In the temporary locking position, the retainer 30 is prevented from moving in the forward direction as a result of the temporary locking projections 34 formed on the rear ends of the upper and lower arms 33*a*, 33*b* contacting the front edges of the first probe receiving openings 13. The retainer 30 is prevented from moving in the rearward direction as a result of the main locking projections 36 contacting the front edge of the top wall of the housing 10.

The contacts 20 that have the electrical wires W connected thereto are inserted into the contact accommodating cavities 11 from the rear side of the housing 10. As the contacts 20 are inserted, the locking arms are deflected until the locking arms 12 are positioned on the rear sides of the receptacles 21 of the contacts 20. The contacts 20 are tentatively secured by the locking arms from slipping out of the housing 10.

Figure 9:
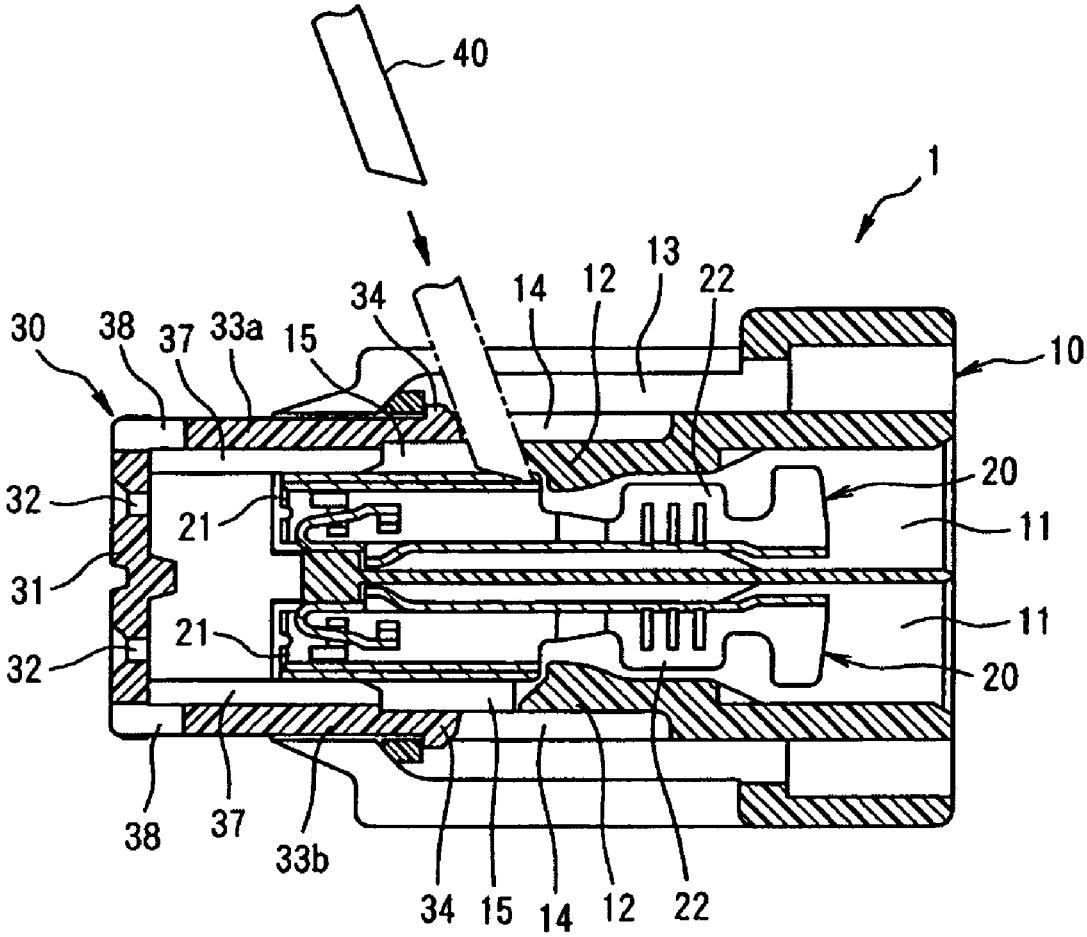
FIG. 9 is a sectional view of the electrical connector showing an electrical continuity check being performed when the retainer is in the temporary locking position.

In the temporary locking position, the upper arms 33*a* of the retainer 30 are in a forward position and are separated from the front ends of the locking arms 12 by a gap, as shown in FIG. 1B. Accordingly, the electrical continuity probe 40 can gain access to the outer walls of the receptacles 21 of the contacts 20 in either the upper or lower rows after the contacts 20 have been received in the contact accommodating cavities 21 and while the retainer 30 is in the temporary locking position via the first probe receiving openings 13, the retaining arm receiving openings 14 and the abutment member receiving openings 15 formed on the top side of the housing 10, as shown in FIG. 9, or on the bottom side of the housing 10.

The retainer 30 is then pushed rearward so that the retainer 30 is positioned in the main locking position, as shown in FIGS. 2A and 2B. In the main locking position, the locking members 35 of the retainer 30 enter into the locking member receiving openings 18 formed beneath the projection receiving openings 17, and the main locking projections 36 contact the front edges of the projection receiving openings 17 so that the retainer 30 is prevented from moving in the forward direction. In the main locking position, the upper arms 33*a* of the retainer 30 enter into the retaining arm receiving openings 14 formed above the locking arms 12, so that the upward movement of the locking arms 12 is restricted to ensure that the contacts 20 of the upper row are prevented from slipping out of the housing 10. The lower arms 33*b* of the retainer 30 enter into the retaining arm receiving openings 14 formed beneath the locking arms 12, so that the downward movement of the locking arms 12 is restricted to ensure that the contacts 20 of the lower row are prevented from slipping out of the housing. As shown in FIGS. 2A and 2B, the rear ends of the upper arms 33*a* and the lower arms 33*b* of the retainer 30 are positioned either above or below the locking arms 12, thereby closing off the abutment member receiving openings 15, as seen from above. The assembly of the electrical connector 1 is thereby complete.

When the electrical continuity check is to be performed after the assembly of the electrical connector 1 has been completed, the electrical continuity check probe tools 51, 52 are first disposed above and below the housing 10, as shown in FIG. 10A. As is shown in FIG. 10B, the electrical continuity check probe tools 51, 52 are then closed, and attached to the housing 10 so that the electrical continuity probes 53, 54 are respectively passed through the second probe receiving openings 38 formed in the retainer 30. As a result, the electrical continuity probes 53, 54 contact the outer walls of the receptacles 21 of the contacts 20 to perform the electrical continuity check.

In the electrical connector 1 of the invention, since the first probe receiving openings 13, the retaining arm receiving openings 14 and the abutment member receiving openings 15 allow the electrical continuity probe 40 to access the contacts 20 when the retainer 30 is in the temporary locking position, an electrical continuity check can be performed in cases where the retainer 30 is in the temporary locking position. Furthermore, since the second probe receiving openings 38 allow the electrical continuity probes 53, 54 to access the contacts 20 when the retainer 30 is in the main locking position, an electrical continuity check can also be performed in cases where the retainer 30 is in the main locking position.

An embodiment of the present invention was described herein. However, the present invention is not limited to this embodiment. Various alterations and modifications are possible. For example, as long as openings that allow the electrical continuity probe 40 to achieve access to the contacts 20 when the retainer 30 is in the temporary locking position are formed in the housing 10, access need not necessarily be achieved by the first probe receiving openings 13, the retaining arm receiving openings 14 and the abutment member receiving openings 15.

We claim:

1. An electrical connector, comprising:

an insulating housing having a plurality of contact accommodating cavities extending from a front side to a rear side of the housing, each of the contact accommodating cavities having a first probe receiving opening formed adjacent thereto; and a retainer attached to the front side of the housing, the retainer being moveable between a temporary locking position and a main locking position, the contact accommodating cavities being accessible through the first probe receiving openings when the retainer is in the temporary locking position and the contact accommodating cavities being accessible through a top wall of the housing through second probe receiving openings formed in the retainer when the retainer is in the main locking position.

2. The electrical connector of claim 1, wherein the retainer includes retaining arms that extend into the housing between the contact accommodating cavities and the first probe receiving openings.

3. The electrical connector of claim 1, wherein the housing has locking arms that extend into the contact accommodating cavities in the temporary locking position, the retaining arms being positioned adjacent to the locking arms in the main locking position.

4. The electrical connector of claim 1, wherein the contact accommodating cavities are formed in upper and lower rows.

5. The electrical connector of claim 1, wherein the second probe receiving openings are formed proximate the front side of the housing.

6. The electrical connector of claim 1, the retainer is spaced from the front side of the housing in the temporary locking position and abuts the front side of the housing in the main locking position.

7. The electrical connector of claim 1, wherein the retainer has projections for securing the retainer in the temporary locking position and the main locking position.

8. The electrical connector of claim 1, further comprising contacts arranged in the contact accommodating cavities, the contacts having a receptacle and an electrical wire connecting member, the contacts being receivable in the contact accommodating cavities when the retainer is in the temporary locking position and being secured in the housing when the retainer is in the main locking position.

9. The electrical connector of claim 8, wherein the receptacle is arranged adjacent to the first and second probe receiving openings.

10. An electrical connector, comprising:

an insulating housing having a plurality of contact accommodating cavities extending from a front side to a rear side of the housing, each of the contact accommodating cavities having a first probe receiving opening formed adjacent thereto; and a retainer attached to the housing and having retaining arms that extend into the housing, the retainer being moveable between a temporary locking position and a main locking position, the contact accommodating cavities being accessible through a top wall of the housing through the first probe receiving openings when the retainer is in the temporary locking position and the contact accommodating cavities being accessible through the top wall of the housing through second probe receiving openings formed in the retainer arms when the retainer is in the main locking position.

11. The electrical connector of claim 10, wherein the retaining arms extends between the contact accommodating cavities and the first probe receiving openings.

12. The electrical connector of claim 10, wherein the housing has locking arms that extend into the contact accommodating cavities in the temporary locking position, the retaining arms being positioned adjacent to the locking arms in the main locking position.

13. The electrical connector of claim 10, wherein the second probe receiving openings are formed proximate the front side of the housing.

14. The electrical connector of claim 10, the retainer is spaced from the front side of the housing in the temporary locking position and abuts the front side of the housing in the main locking position.

15. The electrical connector of claim 10, wherein the retainer has projections for securing the retainer in the temporary locking position and the main locking position.

16. The electrical connector of claim 10, further comprising contacts arranged in the contact accommodating cavities, the contacts having a receptacle and an electrical wire connecting member, the contacts being receivable in the contact accommodating cavities when the retainer is in the temporary locking position and being secured in the housing when the retainer is in the main locking position.

17. The electrical connector of claim 16, wherein the receptacle is arranged adjacent to the first and second probe receiving openings.

* * * * *